United States Patent [19]

Sproule

[11] Patent Number: 5,064,244

[45] Date of Patent: Nov. 12, 1991

[54] RECLINING SOFA

[75] Inventor: James Sproule, Grand Rapids, Mich.

[73] Assignee: The Gentry Gallery, Inc., Ripley, Miss.

[21] Appl. No.: 637,313

[22] Filed: Jan. 3, 1991

[51] Int. Cl.[5] ..... A47C 1/02

[52] U.S. Cl. ..... 297/68; 297/83; 297/85; 297/194; 297/257; 297/411; 297/DIG. 7

[58] Field of Search ..... 297/83–85, 297/88, 89, 68, DIG. 7, 194, 232, 257, 411

[56] References Cited

U.S. PATENT DOCUMENTS

| | | | |
|---|---|---|---|
| 797,826 | 8/1905 | Sherman, Jr. | 297/232 X |
| 2,264,491 | 12/1941 | Ward | 297/249 X |
| 2,505,687 | 4/1950 | Murphy et al. | 297/232 X |
| 2,859,803 | 11/1958 | McCallister | 297/194 X |
| 3,588,170 | 6/1971 | Kuzbusch et al. | 297/83 X |
| 3,748,012 | 7/1973 | Abelman | 297/248 X |
| 4,078,842 | 3/1978 | Zur | 297/DIG. 3 X |
| 4,625,345 | 12/1986 | Wood | 5/13 |
| 4,668,011 | 5/1987 | Fister, Jr. | 297/248 X |
| 4,696,612 | 9/1987 | Burnett et al. | 297/84 X |
| 4,740,031 | 4/1988 | Rogers, Jr. | 297/85 |

*Primary Examiner*—Laurie K. Cranmer
*Assistant Examiner*—Milton Nelson, Jr.
*Attorney, Agent, or Firm*—Wolf, Greenfield, & Sacks

[57] ABSTRACT

A sectional sofa having one sofa section that includes a pair of reclining seats that are separated by a console on which push button controls are mounted that separately control the movement of the reclining seats from the upright to the reclined positions.

21 Claims, 6 Drawing Sheets

Fig. 3A
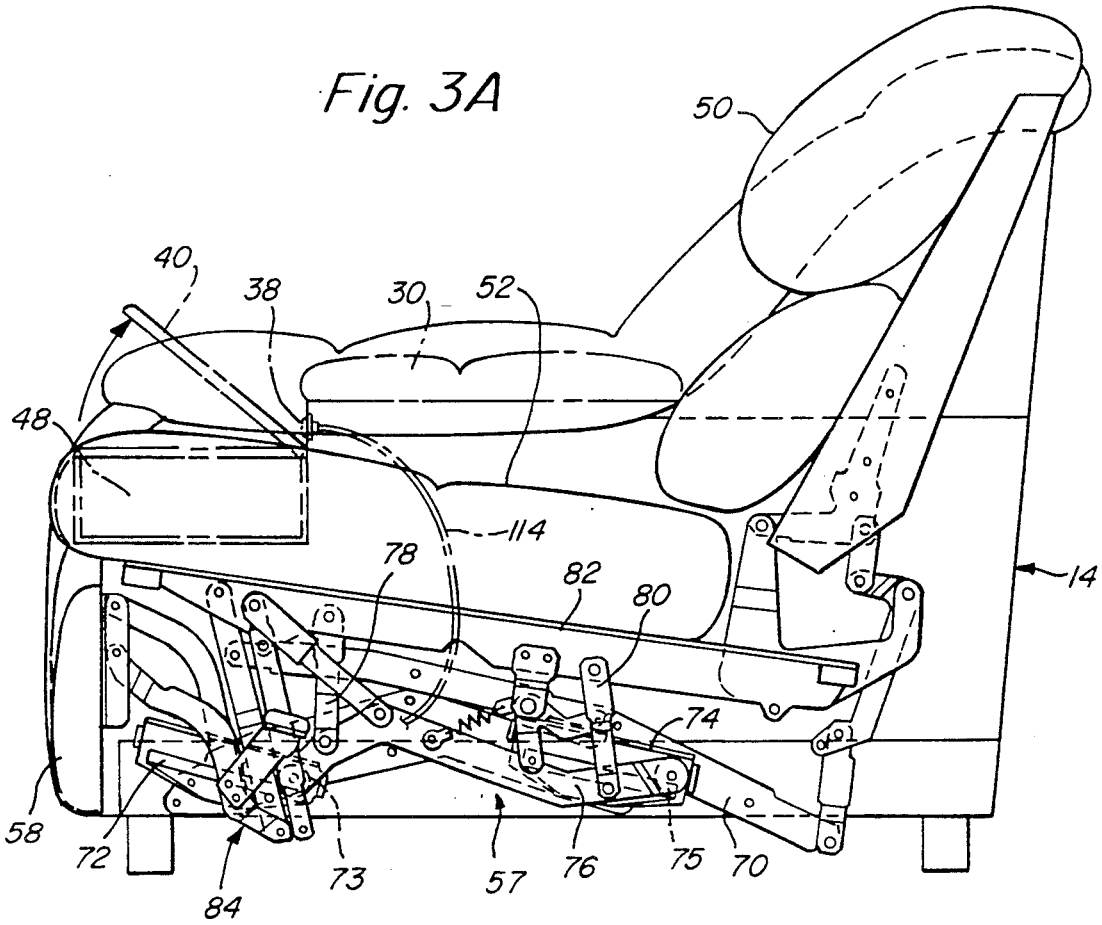
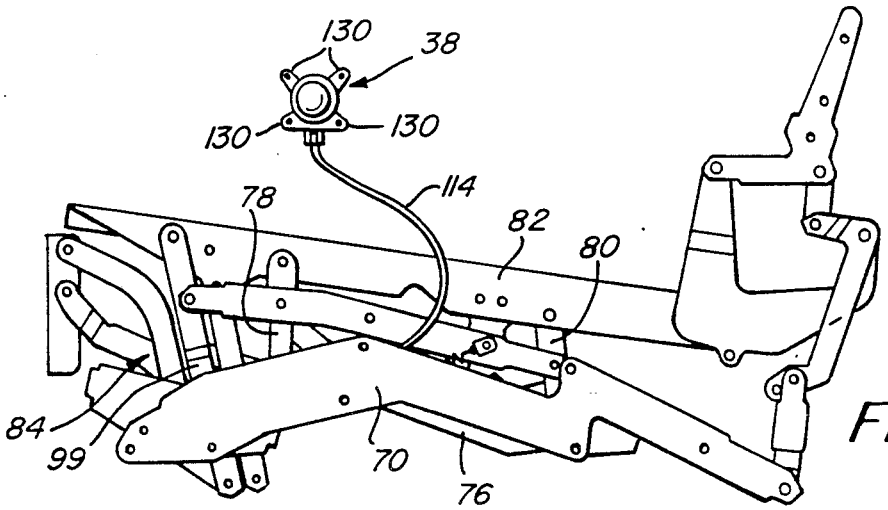
Fig. 5
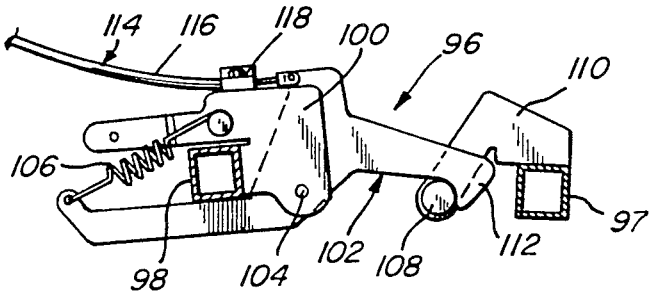
Fig. 6

RECLINING SOFA

FIELD OF INVENTION

This invention relates to sofas and more particularly to sectional sofas having reclining seats incorporated into it.

BACKGROUND OF THE INVENTION

As homes become smaller and more efficiently furnished, the need for a dual purpose seating system becomes more important. For example, there is now a substantial demand for sofas having a reclining chair built into them. There is also a substantial demand for sofas having more than one reclining seat. Heretofor reclining seats have only been provided in sectional sofas at the extreme ends of the end sections, and they have been controlled by handles mounted on the end arms at the ends of the sofa. This arrangement is not usually comfortable when the occupants are watching television because one or both occupants must turn their heads to watch the same set. Furthermore, the separation of the two reclining seats at opposite ends of a sectional sofa is not comfortable or conducive to intimate conversation.

SUMMARY OF INVENTION

The principle object of the present invention is to provide a sofa section that has a pair of reclining seat sections and which is capable of being used as part of a sectional sofa.

Another object of the present invention is to provide a sectional sofa segment having a pair of reclining seat sections built into it with a console positioned between them that accommodates the controls for both of the reclining seats.

Another object of this invention is to provide a sectional sofa with two reclining seats on the same side of the corner or wedge section of the sofa.

Another object of this invention is to provide a reclining seat unit that includes easily accessible controls.

A sectional reclining sofa according to this invention features a pair of reclining seat sections each having a back, seat and extending footrest. Each of the seat sections reclines independently of the other and preferably the reclining seat sections have both a partially reclined, or TV, and a fully reclined position in addition to an upright position. The seat sections are joined toqether by a center console that may extend above the level of the seat cushion of each, thus forming a center pedestal. The pedestal may be upholstered to make it more comfortable for use as an armrest. The front face of the pedestal may carry a pair of push buttons each located adjacent to its respective reclining seat. The push buttons, by means of flexible cables, may lock and unlock each of the reclining mechanisms in order to allow each occupant to operate his/her reclining seat. The console may further include a storage bin having a pivotally mounted top for closing and opening the bin. As noted, the present invention contemplates the use of the sofa section having the reclining seats in a larger sectional seating arrangement in which additional wedge and straight or curved sofa sections are used.

The foregoing objects, features, and advantages, as well as others, will become more apparent in light of the following detailed description read with reference to the drawings in which:

BRIEF DESCRIPTION OF THE DRAWINGS

FIGS 3A–3C are diagrammatic side views of one of the reclining seats in the sectional sofa of FIGS. 1 and 2 showing one form of mechanism that may be used and further showing the reclining seat and mechanism in the upright, partially reclined (TV) and reclined positions, respectively;

FIG. 5 is a detail view of the reclining mechanism used in the reclining seats in FIGS. 1 4 viewed from the inside and further showing a push button control and cable for the latching mechanism which controls the reclining mechanism; and FIG. 6 is a detail view of the latching mechanism, viewed from the side opposite that of the mechanism of FIG. 5.

DETAILED DESCRIPTION OF THE PREFERRED EMBODIMENT

Figure 1:
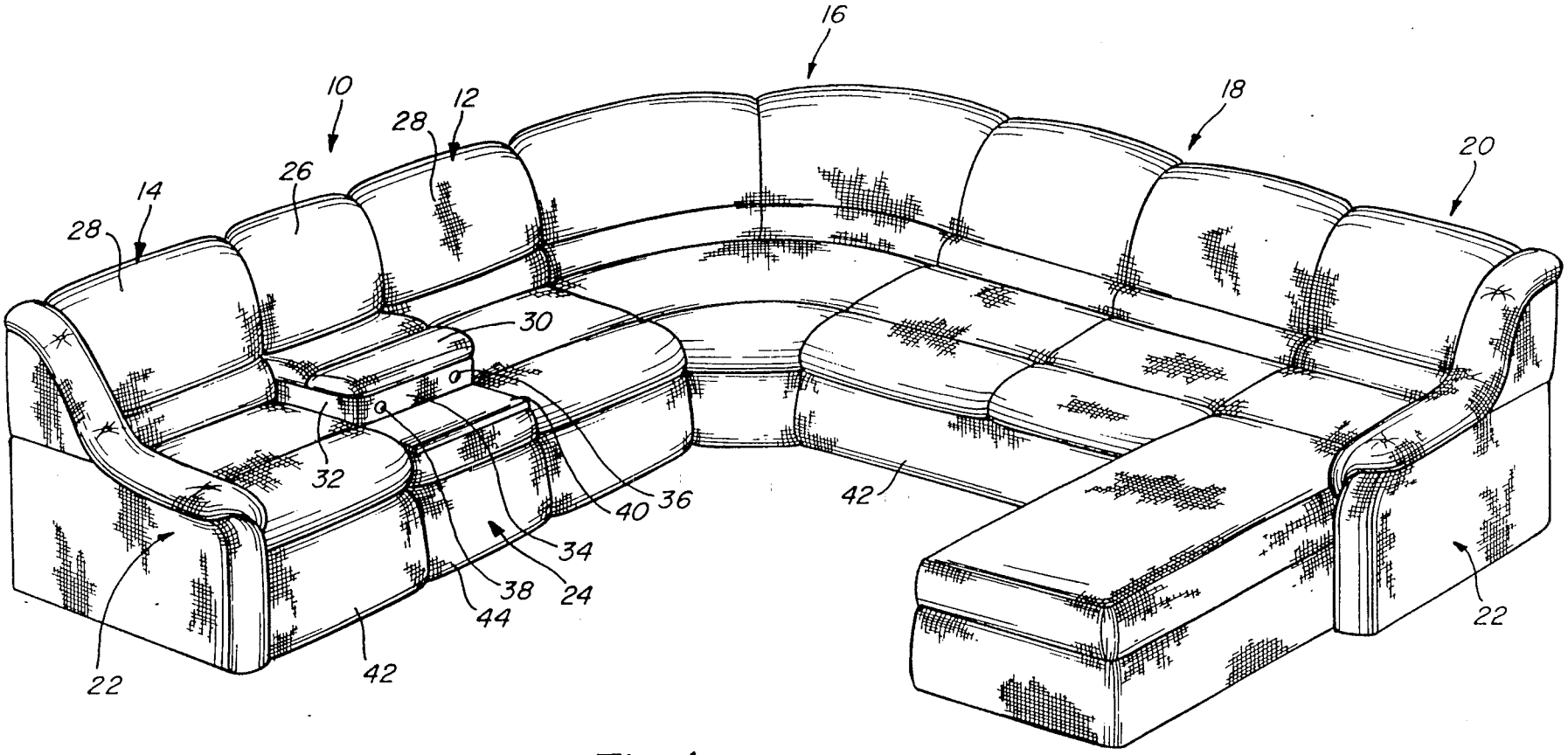
FIG 1 is a perspective view of a sectional sofa including two reclining seats, constructed in accordance with this invention the seats in the upright position.

FIG. 1 depicts a sectional sofa arrangement that includes a double reclining seat sofa section 10 according to this invention with right and left reclining seats 12 and 14, respectively. The sofa section 10 is cushioned in a relatively conventional manner and matches the lines of the rest of the sectional unit which in the arrangement shown includes a curved or wedge-shaped piece 16, a second double sofa section 18 and a divan style end couch 20. The sofa section 10 and couch 20 form the ends of the sectional arrangement, and each includes a padded armrest 22 on the outlying side.

Figure 3B:
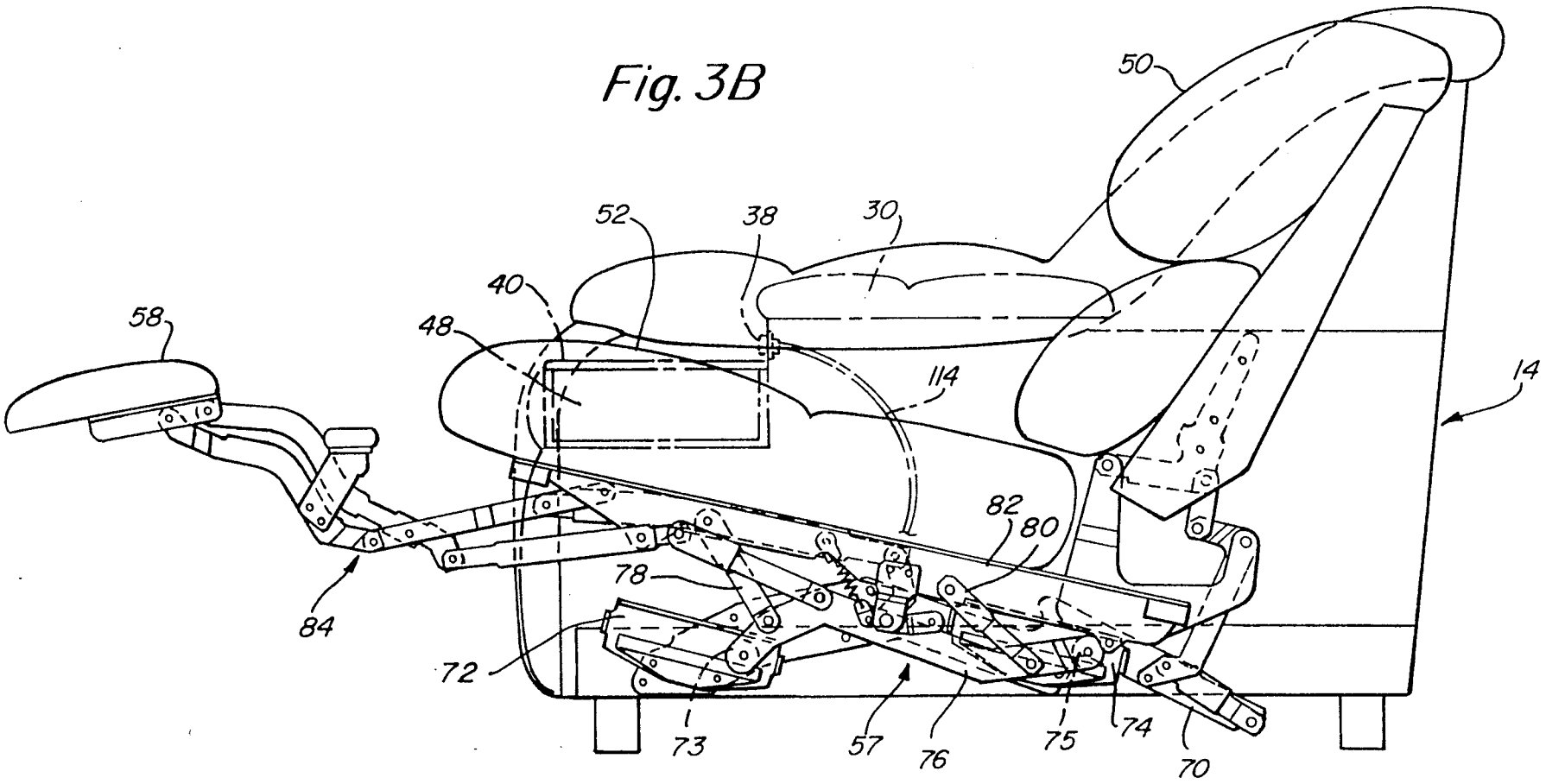
Figure 3C:
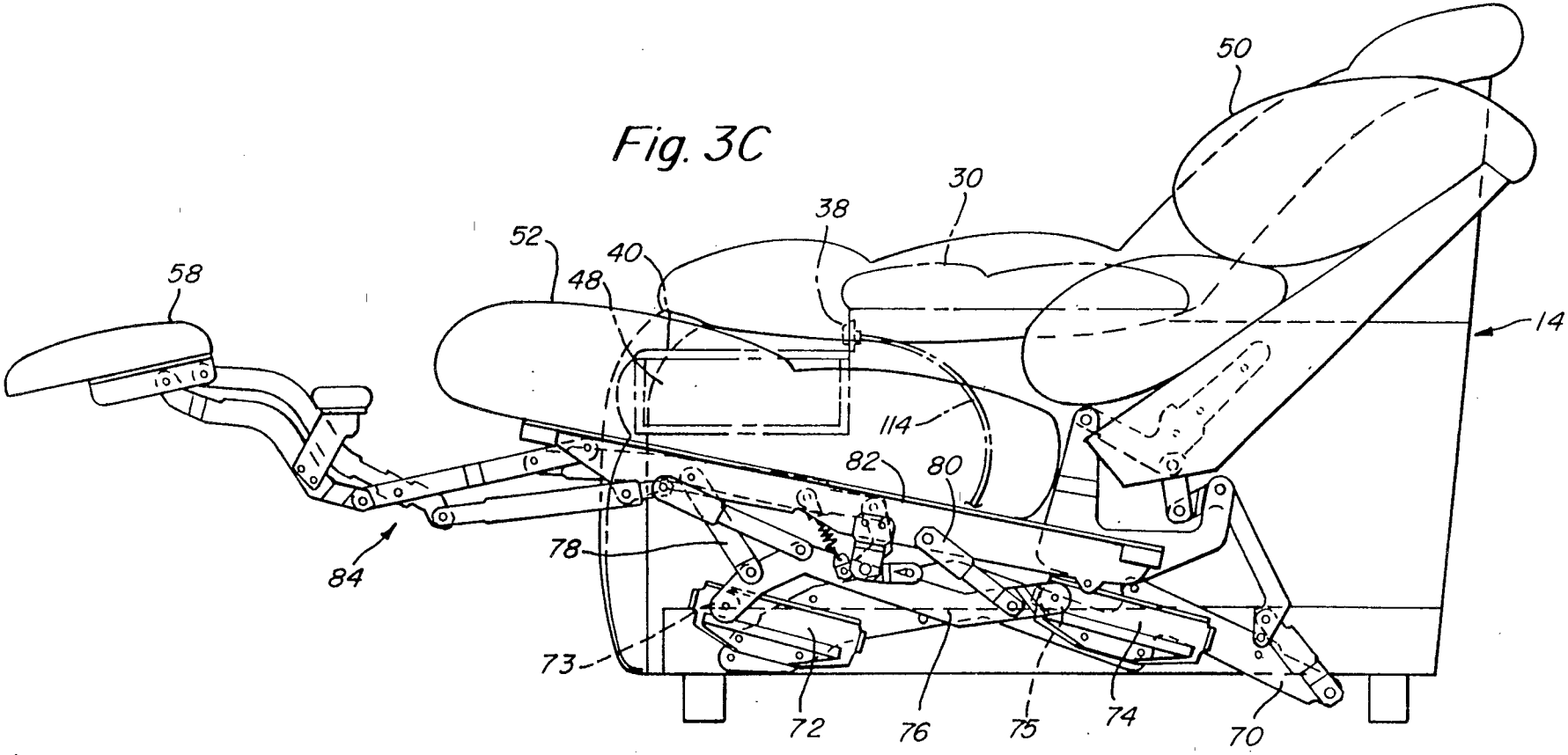

Unlike conventional sofas, the sofa section 10 includes a center console unit 24. The console unit carries a cushioned back 26 similar to the reclining seat backs 28. Thus, the overall "flow" of the sectional design is unbroken. The console 24 also includes a padded armrest 30 overlying a raised pedestal 32. At the front of the raised pedestal 32, a vertical step 34 is visible. The step 34 contains two push buttons 36 and 38 respectively proximate each of the two reclining seats 12, 14. These push buttons unlock the recliner mechanisms of the two seats and allow them to move separately between an upright position as shown in FIGS. 1 and 3A and one of the reclined positions shown in FIGS. 3B, 3C and 4. The center console further includes a table top 40 located in front of the vertical step 34. The sofa design in this example also includes upholstered skirting 42 which is present in each sofa section and which is carried through the center console 24 as shown at 44 below the table top 40. The skirt 42 at the reclining seats 12 and 14 acts as a cover for the footrests as is more fully described below.

It should be understood that the details of the design of the upholstery for the sofa sections and the styling of the console 24 are not part of the present invention. The push button controls 36 and 38 may be mounted on the top or side surfaces of the console rather than on the front wall 34 as shown without departing from this invention.

Figure 2:
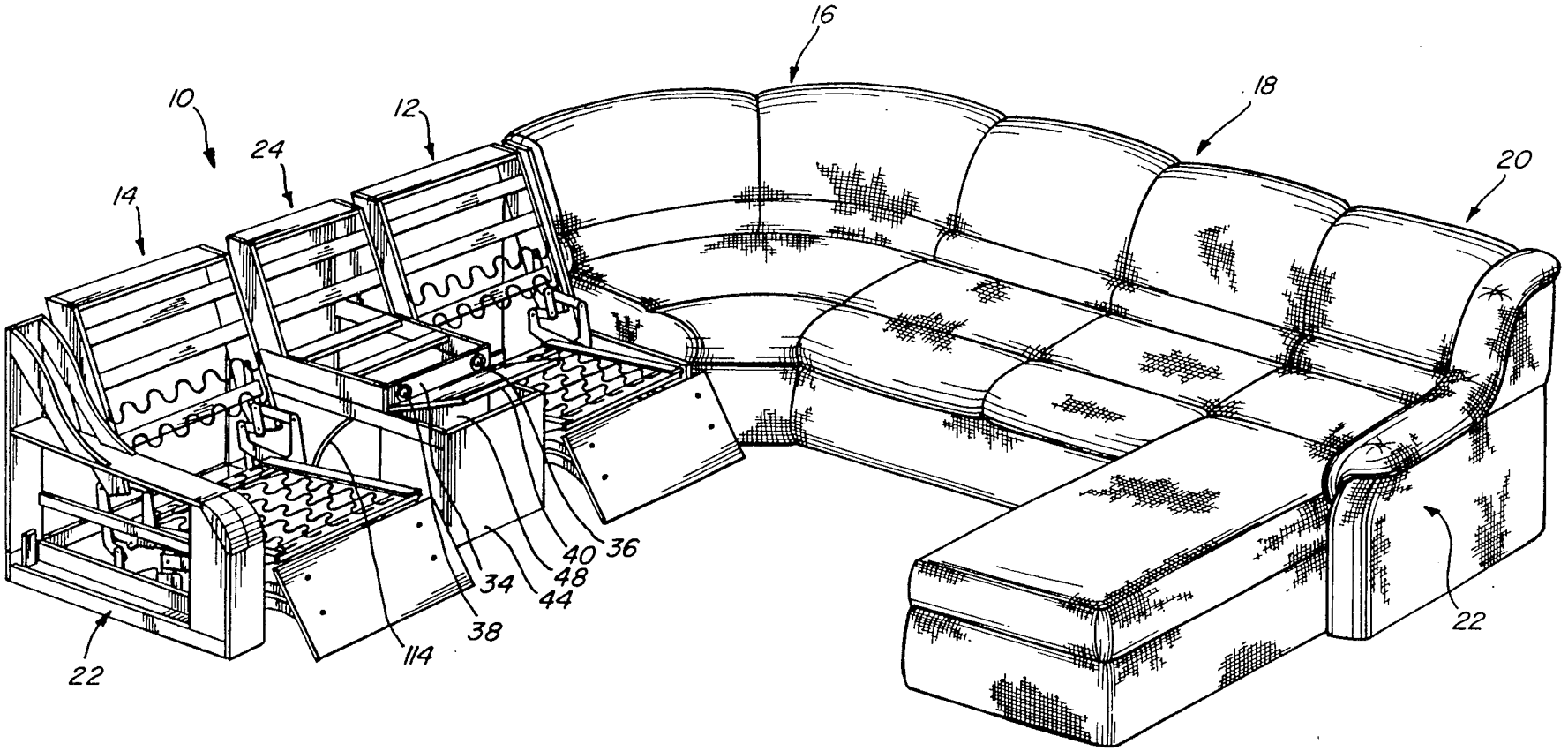
FIG. 2 is a perspective view similar to FIG. 1 but with the upholstery stripped from the two reclining seats and with the seats shown in a partially reclined condition.
Figure 4:
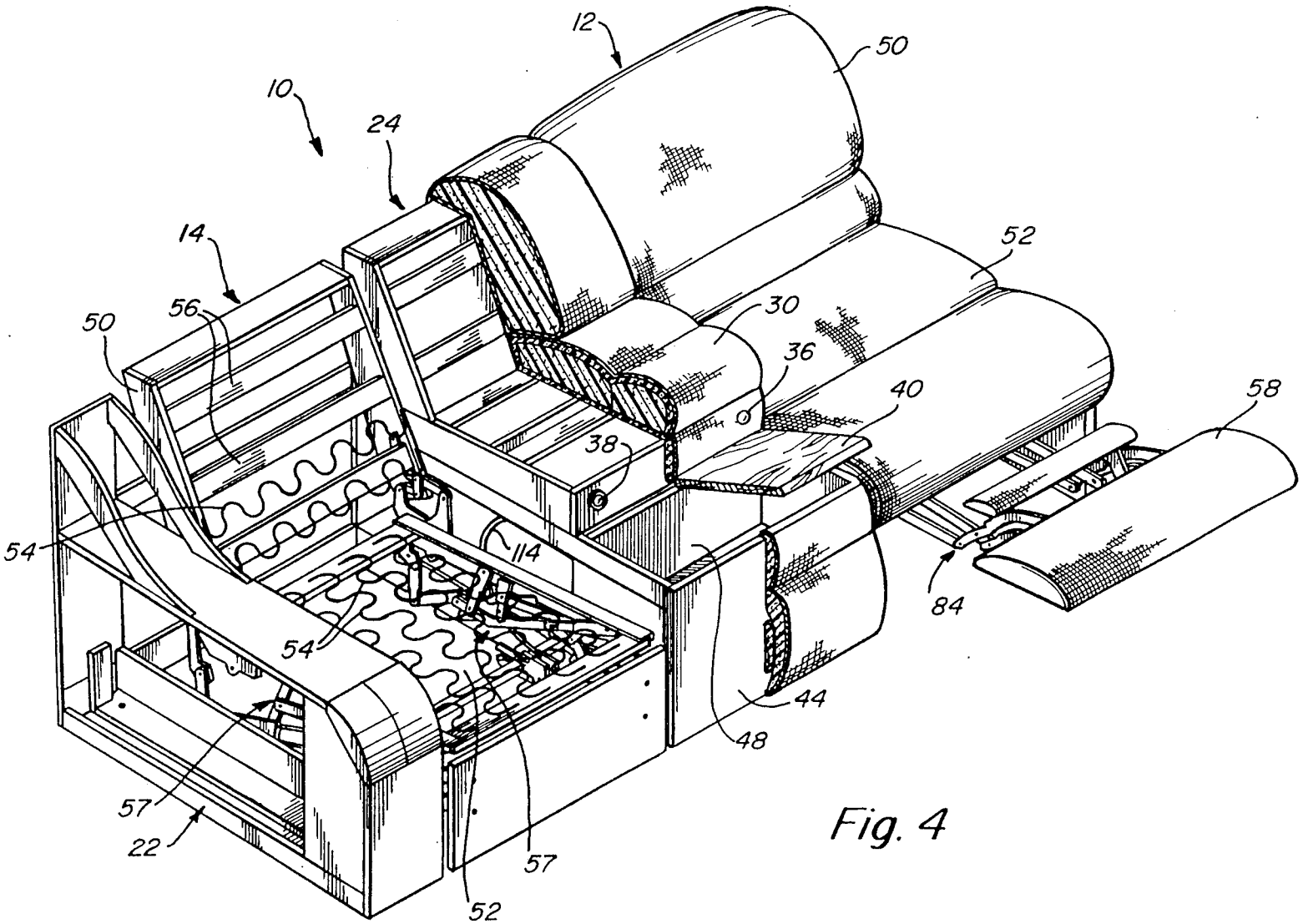
FIG. 4 is a perspective view of one section of the sectional sofa of FIGS. 1 and 2, showing one of the reclining seats in a reclined position and the other with its upholstery stripped away and in the upright position. This figure also shows the console between the reclining seats with its upholstery partially stripped away.

FIGS. 2 and 4 show the underlying framework and springs of the sofa section 10. The frame consists of wood and other suitably storage bracing materials joined by gluing, screws and other metal fasteners. The table top 40 is depicted as pivoting upwardly to open. A storage bin 48 may be constructed below the table top as shown. The storage bin 48 may include racks, removable trays or other dividers within its interior for organizing items such as books and magazines. Similarly, a drawer or cabinet door (neither shown) may be constructed upon the front face 44 of the center console 24 for alternative access to the storage space. As illustrated in FIG. 4, ample cushions are provided on both the backrest 50 and seat 52 of each reclining seat 12, 14, and also at the center console area 24. Sinuous springs 54 are positioned where the greatest loads may be expected. Cross braces 56, which may be made of wood or metal are additionally employed to reinforce the backrests 50 and seats 52.

The mechanisms 57 for each of the reclining seats may be any one of a variety of mechanisms presently available. One such mechanism is manufactured by Super Sagless Corporation of Tupelo, MS and is identified by product number 361. This mechanism enables each of the reclining seats to move from the upright position of FIG. 3A to the partially reclined or TV position of FIG. 3B and to the fully reclined position of FIG. 3C. A pair of mechanisms 57 is employed on each of the reclining seats 12 and 14. In the upright position the footrest 58 is disposed beneath the front of the seat 52 in a vertical plane, while in the TV position the footrest is elevated and the seat 52 and backrest 50 have moved together in a forward direction and tilted in a backward direction as shown in FIG. 3B. In the fully reclined position of FIG. 3C, the backrest 50 and seat 52 have moved toqether further forward on the frame of the sofa section 10 and the backrest 50 has tilted backward relative to the seat 52.

The mechanism 57 shown for accomplishing this motion includes a base mounting plate 70 preferably secured to the sides of the frame (for example, the inside of arm 22 and side of the console 24 for reclining seat 14), a pair of roller tracks 72 and 74, a roller link 76 carrying rollers 73 and 75 in tracks 72 and 74, a pair of pivot links 78 and 80 mounted on the roller link 76, and a seat link 82 carrying the seat 52. The mechanism also includes a lazy, tong linkage 84 mounted on the front portion of the seat link and which carries the footrest 58. It is to be understood that this mechanism is merely exemplary of the types of mechanisms that may be used, and that while a so called three way mechanism is preferred, the simpler two-way mechanisms that are available may also be used.

The reclining mechanism is retained in the upright position by a latching device 96 that also may take one of the several different forms. The latching device 96 is shown in FIG. 6. In the mechanism shown the latching device 96 is mounted on cross tubes 97 and 98 that extend between the reclining mechanisms 57 on each side of the reclining seat. Typically one of the tubes 97 extends between one of the links 99 of the lazy tong linkages 84 on each side of the seat while the other tube extends between the mounting links 70.

The latching device in the mechanism shown includes a bracket 100 that is mounted on the cross tube 98. The bracket 100 pivotally supports a latch 102 by means of pivot 104, and the latch 102 is biased to pivot clockwise as viewed in FIG. 6 by a coil spring 106. A pin 108 carried by a second bracket 110 mounted on the cross tube 97 is positioned to be engaged by the hook 112 of latch 102 when the footrest is retracted to the position of FIG. 3A. The latch 102 is controlled by a cable 114 whose jacket 116 is supported by the clamp 118 mounted on bracket 100. One end of the cable is connected to the latch 102 and the other end is connected to the push button control 36 or 38. The push button controls may take one of several forms, and in the arrangement preferred, depressing the push button exerts a pull on the cable 114 which in turn causes the latch 102 to pivot counterclockwise on the pivot 104 against the bias of spring 106. When the latch is actuated in that fashion, its hook 112 disengages the pin 108 so as to release the lazy tong linkage 84 and allow the footrest to extend on the linkage 84 from beneath the seat 52. The reclining linkage may thereupon move to the partially or fully reclined positions of FIGS. 3B and 3C respectively under the influence of gravity or under the influence of a spring in the mechanism depending upon the particular reclining linkage used. The push button is shown in FIG. 5 and is mounted by means of the ears 130 of the push button control on the step 34.

The operation of the seat is relatively simple using the push button control according to this invention. When a seated person desires to recline the seat from the upright position of FIG. 3A, he need only press the adjacent console mounted push button. This causes the latch 102 to release the pin 108 and the reclining seat may then move to the TV or fully reclined position of FIGS. 3B or 3C, whether the actuation be by gravity, spring loading of the mechanism, pressure applied against the backrest by the occupant or by any other means. The occupants of the two reclining seats may each select the desired position for their respective seats without regard to the position of the other. To return the reclining seats to the upright position, a chair occupant need only apply a downward pressure against the footrest 58 and relieve pressure against the backrest, which causes the lazy tong linkage 84 to collapse and retract the footrest to the position of FIG. 3A and enables the reclining mechanism 57 to close. The latch of FIG. 6 retains the mechanism in the closed position until the push button control is again activated.

From the foregoing description it will be appreciated that the sectional sofa of this invention accomplishes all of the objects of this invention set forth above. Two separately controlled reclining seats are provided on the same side of the sectional sofa which creates a more intimate seating arrangement and makes television viewing equally comfortable for the occupants of both reclining seats. The controls for the two reclining seats are most conveniently located and the console provides both a comfortable arm rest and a convenient storage area adjacent the reclining seats.

It should be understood that the preceding is merely a detailed description of a preferred embodiment of this invention and that various modifications and equivalents can be made without departing from the spirit or scope of the invention. The preceding description, therefore, is not meant to limit the scope of the invention. Rather, the scope of the invention is to be determined by the appended claims and their equivalents.

What is claimed is:

1. A sectional sofa comprising:

a pair of reclining seats disposed in parallel relationship with one another in a double reclining seat sofa section. said double reclining seat sofa section being without an arm at one end whereby a second sofa section of the sectional sofa can be placed in abutting relationship with the end of the double reclining seat sofa section without an arm so as to form a continuation thereof, each of said reclining seats having a backrest and seat cushion and movable between upright and reclined positions, said backrests and seat cushions of the pair of reclining sets lying in respective common planes when the seats are in the same positions, a fixed console disposed in the double reclining seat sofa section between the pair of reclining seats and with the console and reclining seats together comprising a unitary structure, said console including an armrest portion for each of the reclining seats, said arm rests remaining fixed when the reclining seats move from one to another of their positions, and a pair of control means, one for each reclining seat; mounted on the double reclining seat sofa section and each readily accessible to an occupant of its respective reclining seat and when actuated causing the respective reclining seat to move from the upright to the reclined position.

2. The sectional sofa as set forth in claim 1 wherein each of the pair of reclining seats includes a footrest that extends when the reclining seat is moved to a reclined position.

3. The sectional sofa as set forth in claim 2 wherein the double reclining seat sofa section is combined with a plurality of additional sections.

4. The sectional sofa as set forth in claim 1 wherein the center console includes storage means.

5. The sectional sofa as set forth in claim 4 wherein the storage means has a pivoting lid.

6. The sectional sofa as set forth in claim 1 wherein the center console includes a table top.

7. The sectional sofa as set forth in claim 1 wherein the center console extends above the seat of each of the pair of reclining seats.

8. A sectional sofa as set forth in claim 1 wherein the control means includes a pair of hand operated push buttons to respectively operate each of the pair of reclining seats.

9. A sectional sofa as set forth in claim 8 wherein the center console further comprises a vertical step upon which the push buttons are positioned.

10. A sectional sofa as set forth in claim 8 wherein the push buttons are mounted on the console.

11. A sofa as set forth in claim 1 wherein the console includes a back coplanar with the backrests of the reclining seats when the reclining seats are in the upright position.

12. A sectional sofa as set forth in claim 1 wherein the control means are mounted on the console.

13. The sectional sofa as set forth in claim 12 wherein the console includes a table top.

14. The sectional sofa as set forth in claim 13 wherein the console includes storage means.

15. The sectional sofa as set forth in claim 14 wherein the console extends above the set of each of the pair of reclining seats.

16. A sectional sofa comprising:

a pair of sofa sections abutting one another end to end with one of said sections having a pair of reclining seats disposed in parallel relationship with one another in a double reclining seat sofa section, one of said reclining seats being at the end of said one sofa section abutting the end of the other sofa section and with that end of said one section being without an armrest, each of said reclining seats having a backrest, seat cushion and footrest and movable between upright and reclined positions, the backrests, seat cushions and footrests of the pair of reclining seats lying in respective common planes when the seats are in the same positions, a fixed console disposed in the one sofa section between the pair of reclining seats and with the console and reclining seats together comprising a unitary structure, said console including an armrest portion for each of the reclining seats, said arm rests remaining fixed when the reclining seats move from one to another of their positions, and a pair of control means, one for each reclining seat, mounted on the said one sofa section and each readily accessible to an occupant of the respective reclining seats and when actuated causing their respective reclining seats to move from the upright to the reclined position.

17. A sectional sofa as set forth in claim 16 wherein the console further comprises a storage bin.

18. A sectional sofa as set forth in claim 17 wherein the console further comprises a table top pivotally mounted to access and close an opening of the storage bin.

19. A sectional sofa as set forth in claim 16 wherein the control means includes a pair of flexible control cables each having push buttons means at one end mounted on the console, and latching means connected to the other end of each of the cable for releasably preventing the reclining seats from moving from the upright position.

20. A sectional sofa as set forth in claim 16 wherein the control means are mounted on the console.

21. A sectional sofa as set forth in claim 16 wherein the control means includes a pair of push buttons, one for each reclining seat, mounted on the console.

* * * * *